US010094216B2

(12) United States Patent
Moberg et al.

(10) Patent No.: US 10,094,216 B2
(45) Date of Patent: Oct. 9, 2018

(54) MILLING DEPTH COMPENSATION SYSTEM AND METHOD

(71) Applicant: Caterpillar Inc., Peoria, IL (US)

(72) Inventors: Carl J. Moberg, Dunlap, IL (US); Thomas Temmann, Werne (DE); Frank Kuehnemund, Lünen (DE); Martin Teiner, Hamm (DE); Paul Kornev, Herne (DE); Rene Bilsing, Lünen (DE); Brent Duppong, Peoria, IL (US); Brian D. Rockwood, Washington, IL (US); Bjoern-Andre Huehn, Essen (DE); Oliver Kortmann, Werne (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 73 days.

(21) Appl. No.: 15/217,743

(22) Filed: Jul. 22, 2016

(65) Prior Publication Data

US 2018/0023390 A1 Jan. 25, 2018

(51) Int. Cl.

| | |
|---|---|
| ***E21C 35/08*** | (2006.01) |
| ***E21C 25/16*** | (2006.01) |
| ***E21C 41/16*** | (2006.01) |

(52) U.S. Cl.

CPC ..... *E21C 35/08* (2013.01); *E21C 25/16* (2013.01); *E21C 41/16* (2013.01)

(58) Field of Classification Search

CPC ..... E21C 35/24; E21C 27/24; E21C 35/08; E21C 25/16; E21C 41/16; E21D 9/1093; E01C 19/004; G05D 2201/0202

USPC ..... 299/1.4, 1.5, 1.6, 30, 34.11

See application file for complete search history.

(56) References Cited

U.S. PATENT DOCUMENTS

| | | | | |
|---|---|---|---|---|
| 4,033,626 | A * | 7/1977 | Dinkelbach | E21C 27/22 175/45 |
| 4,634,186 | A | 1/1987 | Pease | |
| 4,981,327 | A | 1/1991 | Bessinger et al. | |
| 5,158,341 | A | 10/1992 | Lewins et al. | |
| 5,938,288 | A * | 8/1999 | Saint-Pierre | E21C 35/24 299/1.4 |
| 6,062,650 | A * | 5/2000 | Smith | E21C 35/24 299/1.4 |
| 6,666,521 | B1 | 12/2003 | Pease et al. | |
| 7,896,445 | B2 | 3/2011 | Bechem | |
| 8,157,331 | B2 | 4/2012 | Niederriter et al. | |
| 8,311,710 | B2 | 11/2012 | Budde et al. | |
| 8,979,209 | B2 | 3/2015 | Wade et al. | |

(Continued)

FOREIGN PATENT DOCUMENTS

| | | |
|---|---|---|
| CN | 102278113 A | 12/2011 |
| WO | WO 2004/035990 A2 | 4/2004 |

*Primary Examiner* — Carib A Oquendo

(57) ABSTRACT

A milling depth compensation system for milling rock determines a target position of a machine, an initial position of the work surface, and a target pose of the machine based on the target position of the machine and the initial position of the work surface. An actual pose of the machine is determined and differences between the actual pose and the target pose are used to determine a dynamic milling path of a milling tool. The dynamic milling path includes movement of the milling tool along a first path, a second path, and a third path. Command signals are generated to move the milling tool along the dynamic milling path.

20 Claims, 7 Drawing Sheets

(56) References Cited

U.S. PATENT DOCUMENTS

| | | | | |
|---|---|---|---|---|
| 9,068,453 | B2 | 6/2015 | Rohwer et al. | |
| 9,121,146 | B2 | 9/2015 | Paulsen et al. | |
| 9,222,355 | B2 | 12/2015 | Paterson | |
| 9,359,893 | B2 | 6/2016 | Rohwer et al. | |
| 2003/0226290 | A1* | 12/2003 | Savard | E01C 19/006 37/348 |
| 2012/0068523 | A1* | 3/2012 | Bowles | E21C 35/08 299/1.4 |
| 2012/0161493 | A1 | 6/2012 | Junker et al. | |
| 2014/0091612 | A1 | 4/2014 | Rowher et al. | |
| 2014/0244208 | A1 | 8/2014 | Paulsen et al. | |
| 2015/0204190 | A1 | 7/2015 | Krings et al. | |
| 2016/0084082 | A1 | 3/2016 | Raschka et al. | |
| 2016/0090839 | A1* | 3/2016 | Stolarczyk | E21C 35/24 299/1.4 |

* cited by examiner

MILLING DEPTH COMPENSATION SYSTEM AND METHOD

TECHNICAL FIELD

This disclosure relates generally to a milling system and, more particularly, to a system and method for dynamically modifying the path of a milling tool to compensate for misalignment of a machine on which the tool is mounted.

BACKGROUND

One manner of creating or forming tunnels in rock is to drill holes, insert an explosive into the holes, and detonate the explosives. Such explosive operations require a significant amount of planning and the use of explosives may increase risks associated with such operations.

As an alternative, mobile mining machines have been developed for cutting or milling tunnels and bores underground. The use of such machines in relatively soft materials such as coal is commonplace. However, cutting or milling tunnels and bores in materials harder than coal such as rock tunnels for mining and road construction may be problematic due to the nature of the rock. The cutting or milling operations typically remove a relatively small amount of material in order to avoid damaging the cutting tools and the equipment driving the tools. Misalignment of the mining machines may result in the cutting tools removing too much material along part of a milling path and not enough material being removed along other portions of the path. Such uneven cutting may result in excessive wear to the tooling and/or mining machine at locations where the cutting depth is too great and inefficient material removal at locations at which the cutting depth is too shallow.

U.S. Patent Publication No. 2015/0204190 discloses a mobile mining machine for cutting or milling tunnels and bores in rock. The machine includes a tool drum rotatably mounted on a support arm. The support arm may be raised and lowered and also swung from side to side. A slide carriage unit provides in-feeding capability of the tool drum.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a system for milling material along a work surface includes a milling tool, a position sensor, and a controller. The milling tool is mounted on a machine for removing the material along the work surface, is rotatable about an axis, and is movable relative to the machine along a first path, a second path, and a third path, with the first path being orthogonal to the second path and the third path. The position sensor is associated with the machine and is operative to generate position signals indicative of a pose of the machine. The controller is configured to store a desired machine path of the machine, determine a target position of the machine based upon the desired machine path, determine an initial position of the work surface, and determine a target pose of the machine based on the target position of the machine and the initial position of the work surface. The controller is further configured to determine an actual pose of the machine based upon the position signals from the position sensor, determine differences between the actual pose of the machine and the target pose of the machine, and determine a dynamic milling path of the milling tool based upon the differences between the actual pose and the target pose, with the dynamic milling path including movement of the milling tool along the first path, the second path, and the third path. Command signals are generated to move the milling tool along the dynamic milling path.

In another aspect, a method of milling material along a work surface includes providing a milling tool that is mounted on a machine for removing the material along the work surface, is rotatable about an axis, and is movable relative to the machine along a first path, a second path, and a third path, with the first path being orthogonal to the second path and the third path. The method also includes storing a desired machine path of the machine, determining a target position of the machine based upon the desired machine path, determining an initial position of the work surface, and determining a target pose of the machine based on the target position of the machine and the initial position of the work surface. The method further includes determining an actual pose of the machine based upon position signals from a position sensor associated with the machine, determining differences between the actual pose of the machine and the target pose of the machine, and determining a dynamic milling path of the milling tool based upon the differences between the actual pose and the target pose, with the dynamic milling path including movement of the milling tool along the first path, the second path, and the third path. Command signals are generated to move the milling tool along the dynamic milling path.

In still another aspect, a machine includes a ground engaging drive mechanism for propelling the machine, a milling tool, a position sensor, and a controller. The milling tool is mounted on the machine for removing material along the work surface, is rotatable about an axis, and is movable relative to the machine along a first path, a second path, and a third path, with the first path being orthogonal to the second path and the third path. The position sensor is associated with the machine and is operative to generate position signals indicative of a pose of the machine. The controller is configured to store a desired machine path of the machine, determine a target position of the machine based upon the desired machine path, determine an initial position of the work surface, and determine a target pose of the machine based on the target position of the machine and the initial position of the work surface. The controller is further configured to determine an actual pose of the machine based upon the position signals from the position sensor, determine differences between the actual pose of the machine and the target pose of the machine, and determine a dynamic milling path of the milling tool based upon the differences between the actual pose and the target pose, with the dynamic milling path including movement of the milling tool along the first path, the second path, and the third path. Command signals are generated to move the milling tool along the dynamic milling path.

DETAILED DESCRIPTION

Figure 1:
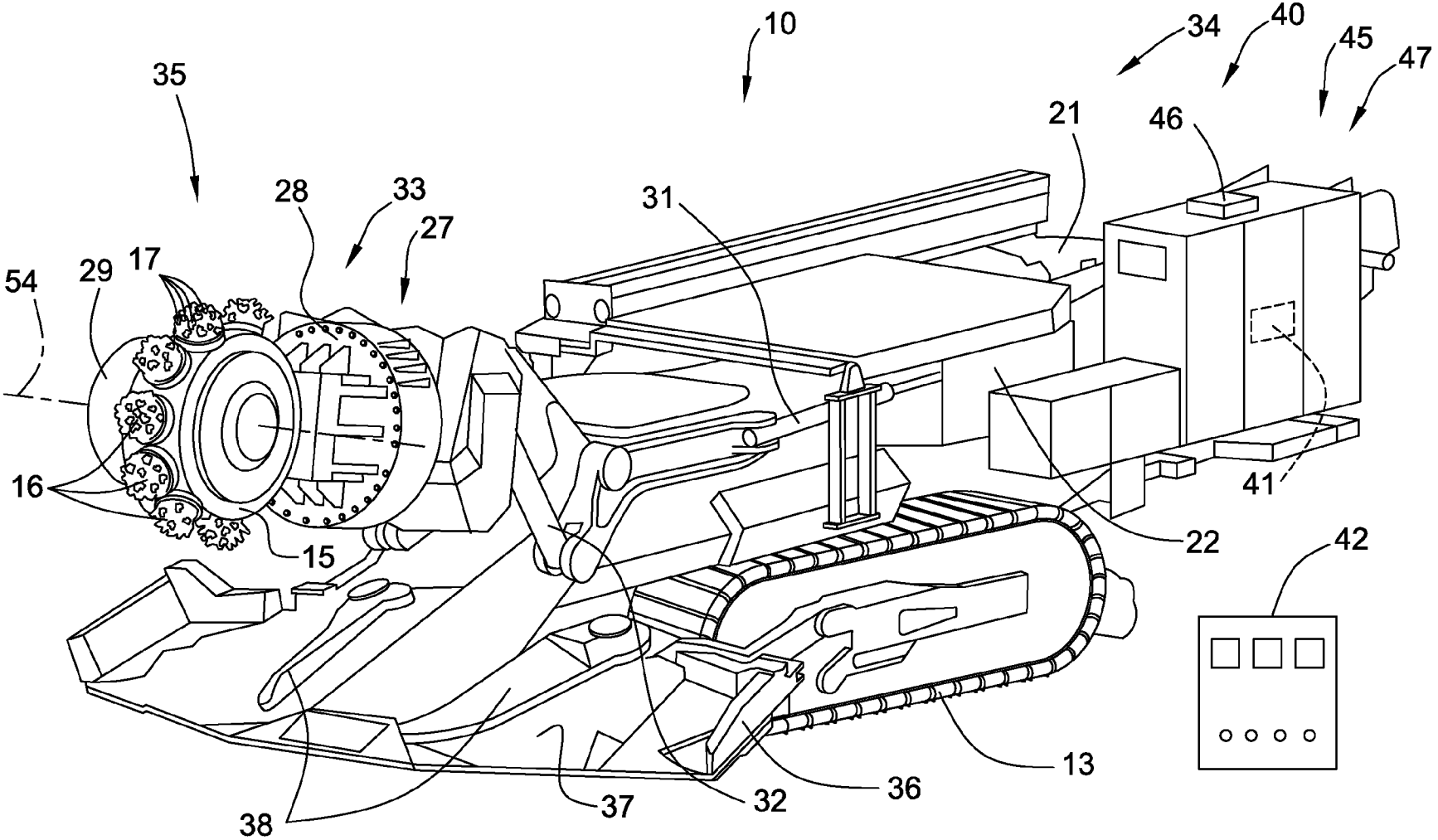
FIG. 1 is a perspective view of a mobile mining machine, with certain parts removed, incorporating the principles disclosed herein.
Figure 2:
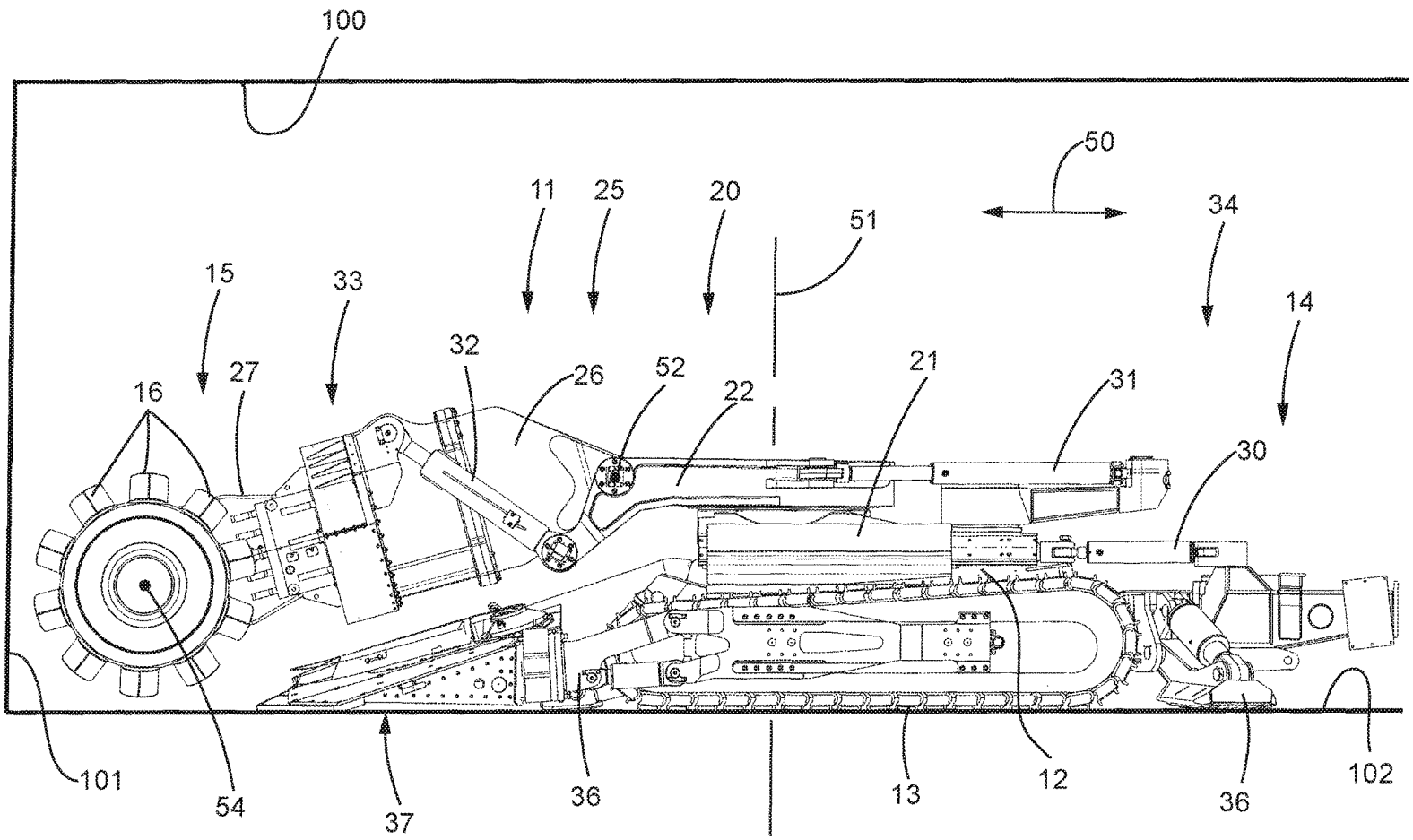
FIG. 2 is a side view of the mobile mining machine of FIG. 1 with other parts removed.
Figure 3:
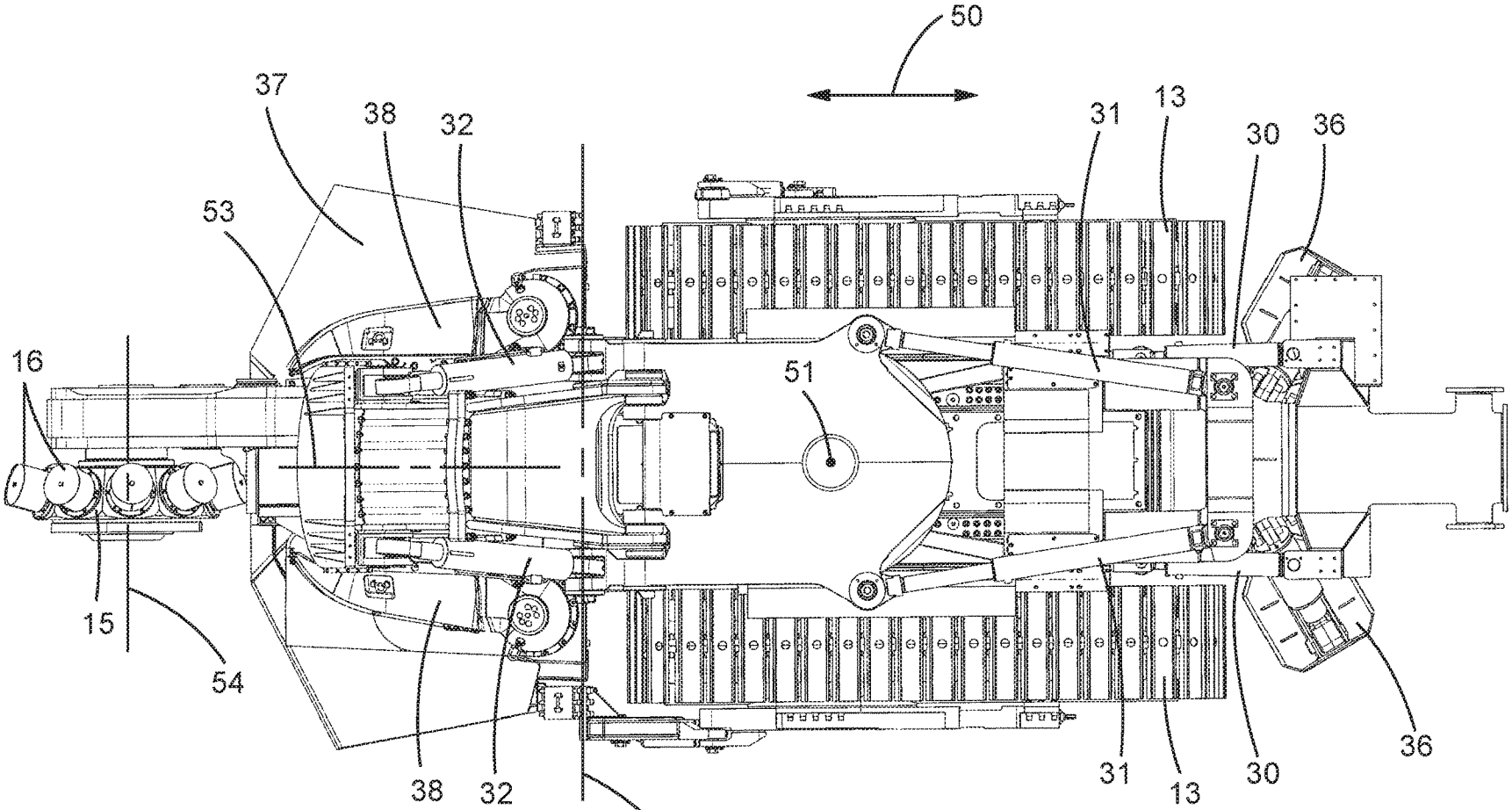
FIG. 3 is a top plan view of the mobile mining machine of FIG. 2.

Referring to FIGS. 1-3, a machine 10 such as a mobile mining machine for creating tunnels 100 (FIG. 2), roadways, or shafts in material (such as rock) is depicted. Machine 10 includes a work implement 11 configured to mill material (such as rock or other materials) at a work site. Machine 10 may include a frame 12 with a ground engaging drive mechanism such as track 13 on opposite sides of the frame to propel the machine. Machine 10 may further include one or more electric motors, generally depicted at 14, that are operatively connected to a remote power source (not shown), which supplies electric power to the machine via one or more power cables (not shown).

Work implement 11 may include a milling tool such as a rotatable cutter head 15 and a tool support and positioning assembly 20. The cutter head 15 may have a plurality of spaced apart tool carriers 16 rotatably mounted thereon. Each tool carrier 16 may include a plurality of milling tools 17. In some embodiments, tips of the milling tools may be made of tungsten carbide. In some embodiments, the tips may be made of polycrystalline diamonds or any other desired material.

The cutter head 15 is rotatably disposed on tool support and positioning assembly 20 that is mounted on the frame 12. Tool support and positioning assembly 20 includes a boom 21, a swing member 22, and a support assembly 25. The boom 21 is slidably mounted on the frame 12 to permit in-feeding of the entire tool support and positioning assembly 20 as well as cutter head 15 towards and away from a wall or work surface 101 to be milled as indicated by the double-headed arrow labeled 50. The swing member 22 is pivotally or rotatably mounted on the boom 21 and it is pivotable about swing axis 51.

Support assembly 25 includes a first member 26 rotatably mounted on swing member 22 to permit rotation or lifting of the support assembly about lift axis 52. A second member 27 of the support assembly 25 is rotatably mounted on first member 26 to permit rotation of the second member about rotation axis 53. The second member 27 may be generally L-shaped with a first section 28 engaging the first member 26 and a second section 29 extending generally perpendicularly to the rotation or support axis 53. The cutter head 15 is rotatably mounted on the second section 29 so as to be rotatable about cutter axis 54.

As a result of the configuration of the tool support and positioning assembly 20, cutter head 15 and support assembly 25 are movable along a first path as a result of the swing movement of swing member 22 and a second path as a result of the lifting movement of the support assembly. Both the first path and the second path, as depicted, are arcuate or in the shape of an arc. In other embodiments, either or both of the first and second pass may be linear. The cutter head 15 and support assembly 25 (as well as swing member 22) are movable along a third path as a result of the sliding or linear movement of boom 21. The first path is thus orthogonal to the second path and the third path.

Sliding or in-feeding of the boom 21 may be achieved by the operation of feed cylinders 30. In-feeding of the boom 21 will result in movement of the entire tool support and positioning assembly 20 as well as the cutter head 15. Rotation or swinging movement of the swing member 22 may be achieved by the operation of swing cylinders 31. Pivoting movement of the swing member 22 relative to the boom 21 will cause all components of the tool support and positioning assembly 20, other than the boom, as well as the cutter head 15 to swing relative to the boom. Lifting movement of the support assembly 25 may be achieved by operation of the lift cylinders 32. Lifting movement of the support assembly 25 will cause vertical movement of the support assembly as well as the cutter head 15. In one embodiment, operation of swing cylinders 31 will cause rotation of swing member 22 about axis 51 which will cause cutter head 15 to follow a horizontal milling path relative to machine 10 while operation of lift cylinders 32 will cause rotation of support assembly 25 about axis 52 which will cause the cutter head to follow a vertical milling path relative to the machine.

Rotation of the second member 27 of support assembly 25 relative to the first member 26 may be achieved by operation of a drive system indicated generally at 33. In one embodiment, the drive system includes an internal gear system (not shown) within the support assembly 25 that is driven by a plurality of hydraulic motors (not shown). Rotational movement of the second member 27 of support assembly 25 will cause rotational movement of the second member as well as the cutter head 15 relative to other components of the tool support and positioning assembly 20.

Each of the cylinders 30-32 may be configured as hydraulic cylinders or any other type of actuator operative to cause movement of the various components. When the cylinders 30-33 are configured as hydraulic cylinders, one or more pumps, generally depicted at 34, may be powered by the electric motors 14 to generate the hydraulic pressure necessary to operate the hydraulic cylinders.

Cutter head 15 and tool carriers 16 may be operatively connected to one or more electric motors, generally depicted at 35, that operate to cause the rotation of the cutter head and tool carriers as desired for a milling operation. In one embodiment, the cutter head 15 and tool carriers 16 may be operatively connected to each other such as by a drive gear assembly (not shown) so that they may be driven by a single motor. In another embodiment, a plurality of motors may be provided and the cutter head 15 and the tool carriers may be independently driven. Relative rotational speeds of cutter head 15 and tool carriers 16 may be fixed or may be changed if desired.

Although the cutter head 15 and tool carriers 16 are depicted as being electrically operated and the components of the tool support and positioning assembly 20 are depicted as being hydraulically operated, each may be operated or driven in any desired manner and with any desired power source.

Retractable stabilizers 36 may be provided to increase the stability of the machine 10 during milling operations. As best seen in FIG. 2, machine 10 may include a stabilizer 36 generally adjacent each corner of the machine. The stabilizers 36 may be hydraulically actuated to move between a transport position or mode while the machine 10 is being moved and a stabilizing position while the machine is performing milling operations. At the transport position, the stabilizers 36 may be raised so that the machine 10 may be transported. At the stabilizing position, the stabilizers 36 may engage the floor at the work site to stabilize the machine 10.

A gathering head mechanism 37 may be positioned generally at the front of machine 10 and is operative to gather material milled by the machine. The gathering head mechanism 37 may be hydraulically actuated to move between a transport position or mode while the machine 10 is being moved and a gathering position adjacent the ground surface the while machine is performing a milling operation. Gathering arms 38 may be operative to assist in transporting milled material away from the work surface 101.

Machine 10 may be controlled by a control system 40 as shown generally by an arrow in FIG. 1 indicating association with the machine 10. The control system 40 may include an electronic control module or controller 41 and a plurality of sensors. The controller 41 may control the operation of various aspects of the machine 10 including the drivetrain and the hydraulic systems.

The controller 41 may be an electronic controller that operates in a logical fashion to perform operations, execute control algorithms, store and retrieve data and other desired operations. The controller 41 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller 41 such as power supply circuitry, signal conditioning circuitry, driver circuitry, and other types of circuitry.

The controller 41 may be a single controller or may include more than one controller disposed to control various functions and/or features of the machine 10. The term "controller" is meant to be used in its broadest sense to include one or more controllers and/or microprocessors that may be associated with the machine 10 and that may cooperate in controlling various functions and operations of the machine. The functionality of the controller 41 may be implemented in hardware and/or software without regard to the functionality. The controller 41 may rely on one or more data maps relating to the operating conditions and the operating environment of the machine 10 and the work site that may be stored in the memory of controller. Each of these data maps may include a collection of data in the form of tables, graphs, and/or equations.

The control system 40 and controller 41 may be located on the machine 10 and/or may be distributed with components located remotely from or off-board the machine. The functionality of control system 40 may be distributed so that certain functions are performed at machine 10 and other functions are performed remotely.

Machine 10 may be operated by a remote control system 42 that may be connected to the machine by cables (not shown) or wirelessly. In the alternative, machine 10 may include a cab or operator station (not shown) in which a machine operator may be positioned. The controller 41 may receive input signals from an operator operating the machine 10 remotely or from within the cab.

Machine 10 may be equipped with a plurality of machine sensors that provide data indicative (directly or indirectly) of various operating parameters of the machine and/or the operating environment in which the machine is operating. The term "sensor" is meant to be used in its broadest sense to include one or more sensors and related components that may be associated with the machine 10 and that may cooperate to sense various functions, operations, and operating characteristics of the machine and/or aspects of the environment in which the machine is operating.

A position sensing system 45, as shown generally by an arrow in FIG. 1 indicating association with the machine 10, may include a position sensor 46 to sense the position and orientation (i.e., the heading, pitch, roll or tilt, and yaw) of the machine relative to the work site. The position and orientation of the machine 10 are sometimes collectively referred to as the pose of the machine. The position sensor 46 may include a plurality of individual sensors that cooperate to generate and provide position signals to controller 41 indicative of the position and orientation or pose of the machine 10.

In one example, the position sensor 46 may include one or more sensors that interact with a remote system such as a laser (not shown) to operate as a position sensor. For example, the position sensor 46 may comprise one or more prisms disposed on the machine 10. Light from a light source such as a laser (not shown) may be reflected by the prisms and received at a receiver (not shown). Based upon a known position of the light source and the reflected light from the prisms, the pose of the machine may be determined. In some instances, light reflected from a single prism may be used to determine a general estimate of the position or pose of the machine 10 and light reflected from two or more prisms used to determine the exact pose of the machine.

The position sensor 46 may further include a slope or inclination sensor such as pitch angle sensor for measuring the slope or inclination of the machine 10 relative to a ground or earth reference. The controller 41 may use position signals from the position sensor 46 to determine the position of the machine 10 at the work site. Other position sensors and other manners of determining the position or pose of the machine are contemplated.

A perception system (not shown) may be mounted on or associated with the machine. The perception system may include one or more systems such as a radar system, a SONAR system, a LIDAR system, a camera vision system, and/or any other desired system that operate with associated perception sensors (not shown). In one embodiment, the perception sensors may generate data that is received by the controller 41 and used by the controller to determine the position of surfaces adjacent the machine 10, including the position of the work surface 101 to be milled.

To perform a cutting or milling operation, machine 10 is positioned at a desired location and the stabilizers 36 extended or positioned to increase the stability of the machine 10. Each of the components of the tool support and positioning assembly 20 may be adjusted so that the cutter head 15 is positioned as desired relative to the work surface 101 to be milled. The cutter head 15 and tool carriers 16 may be operated and feed cylinders 30 may be extended a predetermined distance equal to the desired cutting or milling depth. The swing cylinders 31 may be actuated to cause the swing member 22 to swing along a horizontal arc relative to the machine 10. As the swing member 22 swings or rotates, the support assembly 25 and cutter head 15 move with the swing member along the horizontal arc and engagement of the milling tools 17 with the work surface 101 causes material to be removed from the work surface. After each horizontal swinging movement, the cutter head 15 may be repositioned vertically using the lift cylinders 32 to position the cutter head at a new position at which a new horizontal milling operation may begin. In addition to repositioning the cutter head 15 for the next horizontal milling operation, moving the support assembly 25 using the lift cylinders 32 may also result in a vertical, relative to the machine 10, milling operation.

As used herein each horizontal or vertical milling operation may be referred to as an operation or a pass. A plurality of horizontal and/or vertical milling operations removing a single layer of material may be referred to as a milling cycle. A plurality of milling cycles sequentially removing a plurality of layers of material that are differentiated by different in-feed depths may be referred to as a milling set. In other words, completion of a milling set results in an amount of material being removed that is equal to the milling depth multiplied by the number of milling cycles in the milling set.

Upon completing a milling cycle, the cutter head 15 may be positioned at the original or starting location of the cycle and the feed cylinders 30 extended by a distance equal to the milling depth and another milling cycle begun. A plurality of milling cycles may be completed in this manner until the feed cylinders 30 have reached their maximum travel or in-feed positions. At such point, the machine 10 may be positioned in its transport mode with the stabilizers 36 and gathering head mechanism 37 retracted and the entire tool support and positioning assembly 20 (or only certain components thereof such as feed cylinders 30) may be returned to its initial or retracted position and the machine moved to the next desired location.

Figure 4:
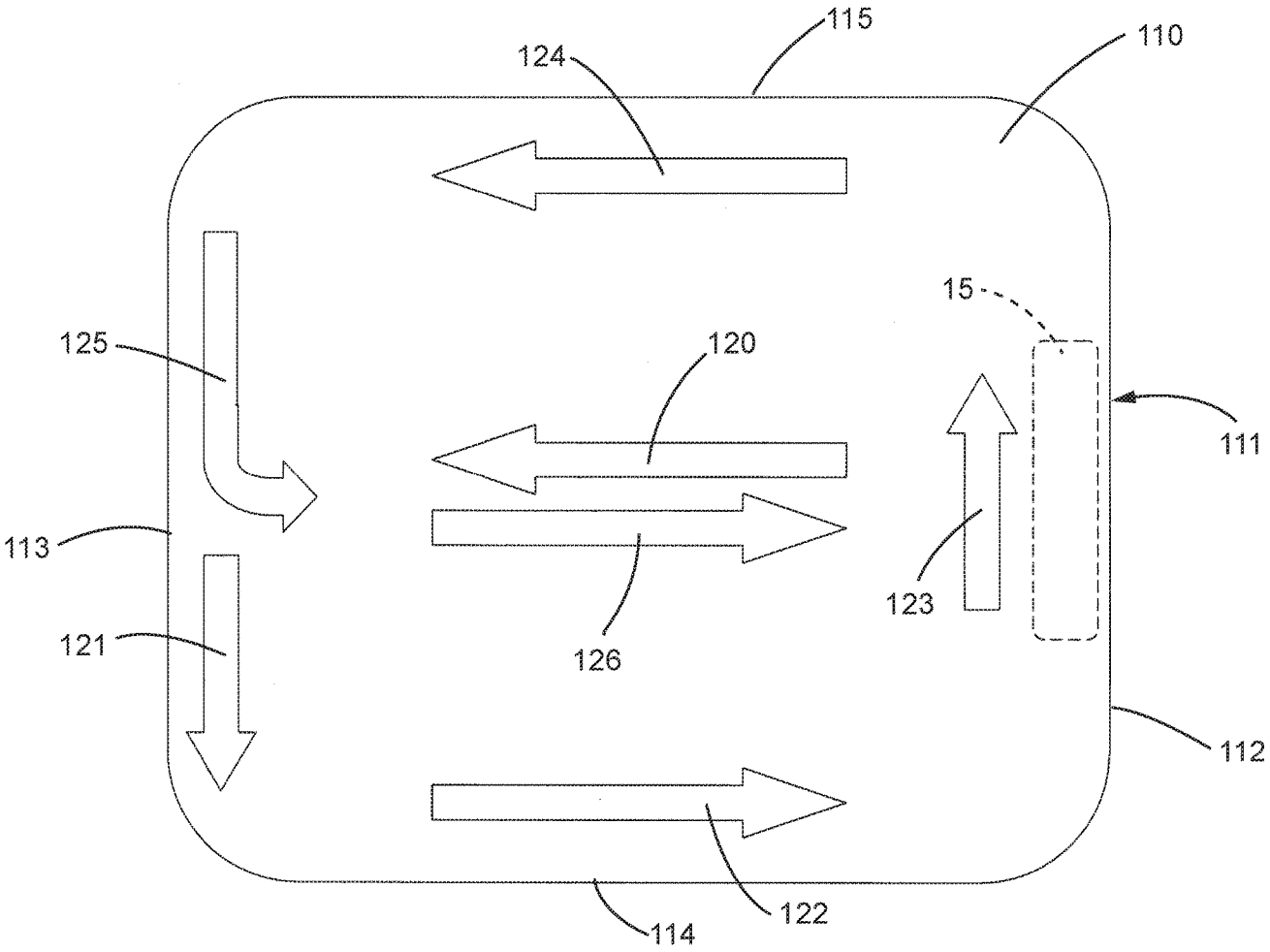
FIG. 4 is a diagrammatic view of a pattern to be milled on a work surface.
Figure 5:
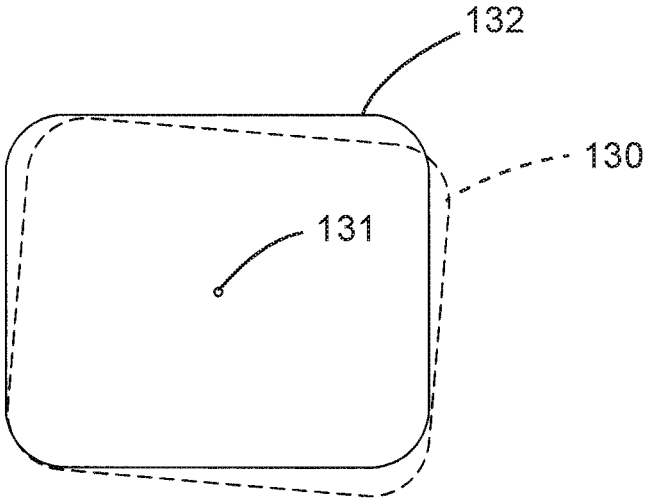
FIG. 5 is a diagrammatic view of a comparison of a target pattern to be milled and the impact of machine role on the target pattern.

Machine 10 may perform a plurality of milling operations or passes, which form a milling cycle, to cut or mill patterns of any desired shape in the work surface. One example of a plurality of milling operations or passes that form a milling cycle to cut or mill a pattern 110 in the shape of a spherical segment is depicted in FIG. 4. Cutter head 15 is initially positioned at a first or initial location depicted at 111 laterally at the outside edge of pattern 110 to be milled and vertically at the center or midpoint of the pattern. Power is provided to the cutter head 15 and tool carriers 16 to generate the desired rotation of the cutter head and tool carriers. Feed cylinders 30 are actuated to cause the boom 21, and thus the entire tool support and positioning assembly 20 as well as the cutter head 15, to move or in-feed towards the work surface 101 to be milled. In doing so, the milling tools 17 of tool carriers 16 of cutter head 15 will contact the work surface 101 at initial location 111 and cause a portion of the work surface engaged by the cutter head to be removed. In one embodiment, the cutter head 15 may have a diameter of approximately 1.9 m, the pattern may be approximately 6 m wide and 5 m tall, and the in-feed movement or milling depth may be approximately 100 mm.

The swing cylinders 31 may be actuated to cause the swing member 22, as well as the support assembly 25 and cutter head 15, to swing horizontally relative to the machine 10 from a first lateral side 112 of pattern 110 to a second lateral side 113, opposite the first side, as depicted by arrow 120. During such swinging movement, material is milled from the work surface 101. Once the cutter head 15 has reached the second lateral side 113, the lift cylinders 32 may be actuated to cause the support assembly 25, as well as the cutter head 15, to move vertically (either up or down) relative to the machine 10 to position the cutter head 15 in the desired location for the next horizontal milling operation. As depicted in FIG. 4, the vertical movement is downward as depicted by arrow 121 so that the cutter head 15 is positioned along the lower boundary 114 of the work surface to be milled. During such vertical movement, material is milled from the work surface 101.

After the cutter head 15 has reached the lower boundary 114 of the work surface 101 along the second lateral side 113, a second horizontal milling operation may be performed by actuating the swing cylinders 31 so that swing member 22, as well as the support assembly 25 and cutter head 15, swing horizontally relative to the machine 10 as depicted by arrow 122 from the second lateral side 113 to the first lateral side 112 (i.e., in a direction opposite the first horizontal milling operation depicted by arrow 120). In doing so, material is milled from the work surface 101.

Upon reaching the first lateral side 112, the lift cylinders 32 may be actuated to cause the support assembly 25, as well as the cutter head 15, to move vertically relative to the machine 10 as depicted by arrow 123 in a direction opposite the first vertical milling operation depicted by arrow 121 and past the initial location 111, to position the cutter head 15 in the desired location for the next horizontal milling operation. As depicted in FIG. 4, the second vertical movement is upward as depicted by arrow 123 until the cutter head 15 is positioned along upper boundary 115 of the work surface 101 to be milled. During such vertical movement, material is milled from the work surface.

Upon reaching the upper boundary 115 of the work surface 101, a third horizontal milling operation may be performed by actuating the swing cylinders 31 so that swing member 22, as well as the support assembly 25 and cutter head 15, swing horizontally relative to the machine 10 as depicted by arrow 124 from the first lateral side 112 to the second lateral side 113 (i.e., in the same direction as the first horizontal milling operation depicted by arrow 120). In doing so, material is milled from the work surface 101.

Once the cutter head 15 has reached the second lateral side 113, the lift cylinders 32 may be actuated to cause the support assembly 25, as well as the cutter head 15, to move vertically (either up or down) relative to the machine 10 to position the cutter head 15 adjacent the vertical center of pattern 110. As depicted in FIG. 4, the vertical movement is downward as depicted by arrow 125 so that the cutter head 15 is aligned with the first horizontal milling operation depicted by arrow 120. During such vertical movement, material is milled from the work surface.

After the cutter head 15 is aligned with the first horizontal milling operation depicted by arrow 120, the cutter head may be returned to the initial location 111 by actuating the swing cylinders 31 so that swing member 22, as well as the support assembly 25 and cutter head 15, swing horizontally relative to the machine 10 as depicted by arrow 126 from the second lateral side 113 to the first lateral side 112 (i.e., in a direction opposite the first horizontal milling operation). During such swing operation, no material is being milled from the work surface 101.

It should be noted that machine 10 may be capable of removing a pattern of material using more than one sequence of milling operations or passes. For example, the pattern depicted in FIG. 4 may be removed using a different sequence of milling operations or passes as compared to that described above. In addition or in the alternative, the same or essentially the same pattern may also be formed using differently configured or oriented milling operations or passes.

When operating at a work site, a plan or route may be generated along which the machine 10 will operate to cut or mill an opening along a desired machine path. In doing so, the machine path may be divided into a plurality of increments with the end point of each increment defining a "way point" for the machine 10 to follow. In some instances, the increments may be straight lines and, in other instances, the increments may be curved. A planning system of the control system 40, on-board or off-board the machine 10, may divide each increment into a plurality of smaller sub-units or sub-increments equal in length to one milling set. In one example, each increment may be one meter long, the milling depth may be 100 mm, and a milling set may include six milling cycles and thus be 600 mm long. In such case, the planning system may divide each increment into a series of sub-increments of 600 mm and the sub-increments may be used to define a plurality of target points for the machine 10 that are 600 mm apart.

A position on the machine 10 may be designated as a datum that is to be positioned at each target point when beginning each milling set. During a milling operation, an operator or an automated system may utilize the position sensing system 45 to move the machine 10 to position the datum of machine relative to the next target point corresponding to the next milling set. A target or tolerance zone may be established around the target point so that it is not necessary to precisely position the machine 10 at the target point. In one example, the tolerance zone may be 50 mm so that the machine 10 must be positioned no more than 50 mm laterally to either side of the target point and 50 mm behind or in front of the target point relative to the work surface to be milled.

In addition to positioning the machine 10 adjacent the target point, the machine must also be positioned at a desired orientation or target attitude. The position of the existing work surface 101 to be milled may be used to define the target attitude of the machine. When the increments or sub-increments are in a straight line, the target attitude of the machine 10 will typically be perpendicular or normal to the surface of the existing work surface 101. With such an attitude, the milling depth will be constant along the arcuate path of movement of the cutter head 15.

It should be noted that, in some instances, adjacent increments or sub-increments may be at an angle to each other to define an arcuate or non-linear portion of the machine path set by the planning system and followed by the machine 10. In those instances, the target attitude may be at an angle to the angle of the work surface 101 to be milled. The relative angle between the target attitude and the work surface 101 may result in the milling depth being non-uniform along the length of a milling operation or an entire milling cycle. In other words, when milling a non-linear portion of a path, the milling depth may not be constant along a milling operation.

The position of the existing work surface 101 may be determined in any desired manner. In one embodiment, the position of the existing work surface may be determined based upon the known position of the machine 10 during the last milling cycle and the known dimensions of the machine. In another embodiment, the position of the existing work surface may be determined through the use of a perception system. In one example, the permitted tolerance for aligning or orienting the machine 10 relative to the existing work surface 101 may be 2 degrees. In other words, an axis running from front to rear through the machine 10 must be aligned within 2 degrees of the machine path defined by the increments or sub-increments. The target point and target attitude may be collectively referred to as the target pose of the machine 10.

Since the machine 10 is cutting or milling rock which may be relatively hard, a relatively small misalignment of the pose of the machine relative to the desired or target pose may cause the milling tools 17 to cut too deep in some locations and not deep enough in other locations. Cutting too deep may result in premature or excessive wear of the cutter head 15, tool carriers 16, milling tools 17, or the gear system of the drive system.

In order to compensate for misalignment of the machine relative to the target pose, control system 40 may include a cut or milling depth compensation system 47 that operates to adjust the position of the cutter head 15 during each milling pass to increase the consistency of the milling depth. By positioning the machine 10 within the desired tolerance of the target pose, the milling depth compensation system 47 may operate to compensate for differences between the actual pose of the machine 10 and the target pose.

FIGS. 5-8 depict examples of different types of machine 10 misalignment and the manner in which the milling depth compensation system 47 operates to compensate for such misalignment. As depicted, the amount of misalignment may be exaggerated for purposes of illustration. In a first example depicted in FIG. 5, if the machine 10 (or the floor 102 upon which is it positioned) experiences some degree of roll (i.e., is rotated about an axis extending front to back through the machine) relative to the target pose, pattern 130 milled by the machine will be rotated about the axis 131 as compared to the desired pattern 132. As a result, some portions of each pass may mill too much material and other portions too little material. In order to compensate for the roll misalignment, the milling depth compensation system 47 may raise or lower the lift cylinders 32 during the milling operation as well as increase or decrease the length of each milling operation. By doing so, the end points of each milling operation are adjusted by the milling depth compensation system 47 to compensate for the roll misalignment of the machine pose relative to the target pose.

Figure 6:
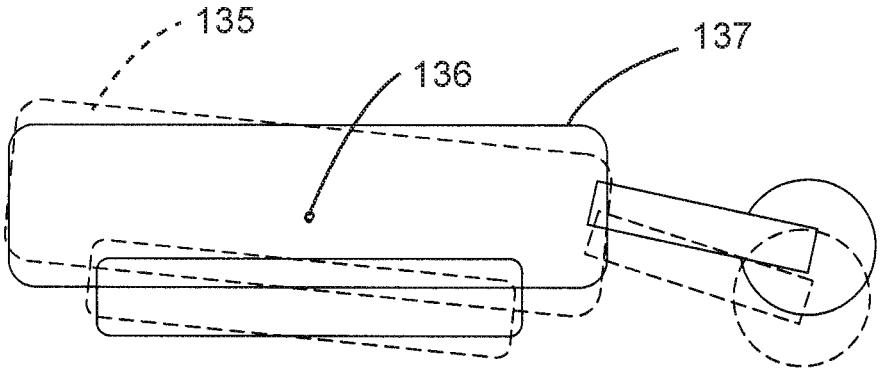
FIG. 6 is a diagrammatic side view of a comparison of a mobile mining machine in a pitched versus an un-pitched position.

In a second example, if the machine 10 (or the floor 102 upon which is it positioned) experiences some degree of pitch (i.e., is rotated about an axis extending between the sides of the machine) relative to the target pose, the vertical height of each pass may change which may result in the milling depth being too deep or too shallow. As depicted in FIG. 6, the machine depicted in phantom at 135 is pitched downward about axis 136 and the milling depth is vertically deeper than if the machine were not pitched as shown at 137. In order to compensate for the pitch misalignment, the milling depth compensation system 47 may raise or lower the lift cylinders 32 as well as increase or decrease the in-feeding of the boom 21 during the milling operation. By doing so, the end points of each milling operation are adjusted by the milling depth compensation system 47 to compensate for the pitch misalignment of the machine pose relative to the target pose.

Figure 7:
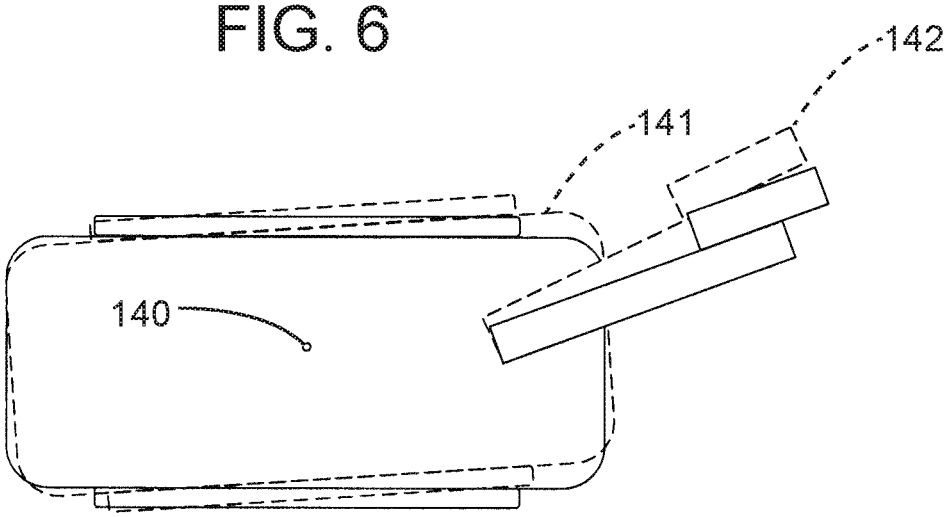
FIG. 7 is a diagrammatic top view of a comparison of a mobile mining machine in a yawed versus un-yawed position.

In a third example, if the machine 10 is yawed (i.e., rotated about an axis 140 extending top to bottom through the machine), the cutter head 15 may swing too far to one side and not far enough to the opposite side during each horizontal pass. As depicted in FIG. 7 the machine depicted in phantom at 141 is yawed about axis 140 and the cutter head depicted in phantom at 142 will move farther to one side during each horizontal pass which will result in too much material being milled and less material being milled at the opposite side of the pass. In order to compensate for the yaw misalignment, the milling depth compensation system 47 may increase or decrease the length of each milling operation as well as increase or decrease the in-feeding of the boom 21. By doing so, the end points of each milling operation are adjusted by the milling depth compensation system 47 to compensate for the yaw misalignment of the machine pose relative to the target pose.

Figure 8:
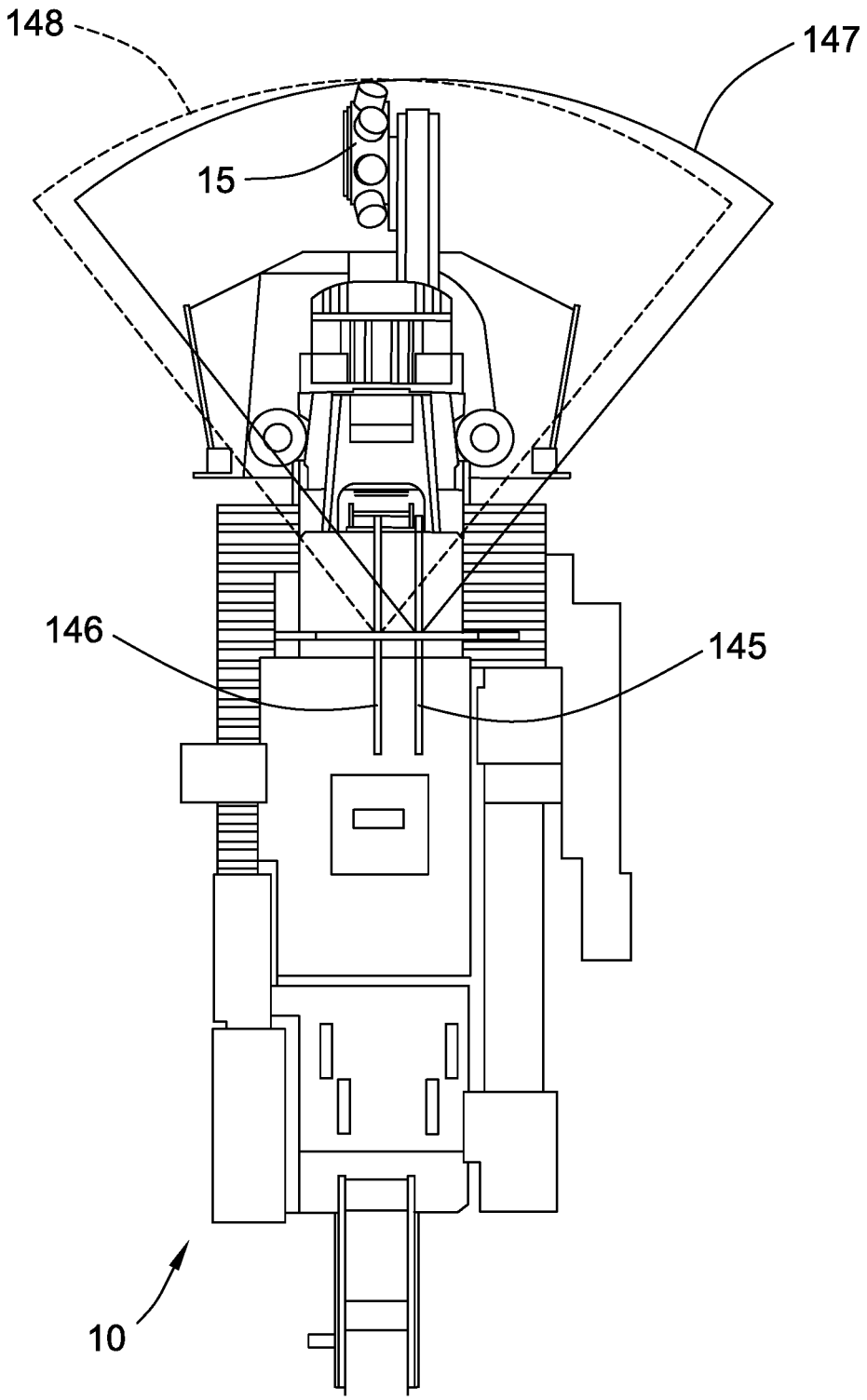
FIG. 8 is a diagrammatic top view of a comparison of a mobile mining machine in a laterally shifted versus un-shifted position.

A fourth example is depicted in FIG. 8 in which the machine 10 is shifted laterally relative to the desired path of the machine. The desired path is depicted at 145 and the centerline of the machine is depicted at 146. The desired movement of the cutter head 15 and swing member 22 are depicted at 147 and the actual movement depicted at 148. As a result, the cutter head 15 will move farther to one side during each horizontal pass, which will result in too much material being milled and less material being milled at the opposite side of the pass. In order to compensate for the lateral misalignment, the milling depth compensation system 47 may increase or decrease the length of each milling operation as well as increase or decrease the in-feeding of the boom 21 in a manner similar to the compensation for yaw misalignment.

Each of the examples described above includes and compensates for only one type of misalignment. The milling depth compensation system 47 may operate to simultaneously compensate for all types or directions of misalignment by determining the total misalignment and simultaneously raising or lowering the lift cylinders 32, increasing or decreasing the length of each milling operation, and increasing or decreasing the in-feeding of the boom 21 to compensate for the total misalignment. By doing so, a dynamic milling path of the cutter head 15 is determined including adjusting the end points of each milling operation to compensate for the overall misalignment of the machine pose relative to the target pose. Such compensation will result in improved milling depth and reduced time spent aligning the machine 10 prior to each milling set.

In another aspect of the operation of milling depth compensation system 47, upon positioning the machine 10 at the target point (with the boom 21 retracted), the differences between the actual pose of machine 10 and the target pose may be determined and the amount of compensation required for a desired or uniform cut depth determined. The first milling cycle may be performed based upon the misalignment compensation provided by the milling depth compensation system 47. After completing the first milling cycle, the feed cylinders 30 may be extended by a distance equal to the milling depth and another milling cycle performed without moving the machine 10 and without requiring a new misalignment calculation and compensation process. Additional milling cycles may be performed by extending the feed cylinders 30 after each milling cycle is completed until reaching the end of the stroke of the feed cylinders. At such time, the machine 10 may be positioned in its transport mode, the feed cylinders 30 retracted, and the machine moved to the next target point. The process of determining the misalignment and the misalignment compensation, as well as the milling cycles may then be repeated as desired. By utilizing sub-increments that correspond in length to the total milling depth of a milling set, improved efficiency of the milling process may be achieved by eliminating the necessity of determining the misalignment compensation for each milling cycle.

Although described in the context of generating a uniform cutting depth, the milling depth compensation system 47 may also be operative when a portion of the path defined by the increments or sub-increments is non-linear. In other words, regardless of whether the milling depth is uniform, the milling depth compensation system 47 may still be useful to assist in positioning the cutter head 15 at the target pose so as to maintain a desired milling depth or desired milling path to reduce the likelihood of excessive or premature wear to the machine 10. In addition, the milling depth compensation system 47 may also be used with other systems and machines regardless of their milling or cutting operation. For example, the milling depth compensation system 47 may be useful to assist in positioning a work implement (such as a cutter head) of a machine that utilizes a linear, rather than arcuate, milling motion.

INDUSTRIAL APPLICABILITY

The industrial applicability of the system described herein will be readily appreciated by the foregoing discussion. The foregoing discussion is applicable to machines used to cut or mill rock. The system may be used at a mining site, construction site, road work site, or any other area in which cutting or milling of rock is desired.

As machines 10 such as mobile mining machines operate to mill rock, the processes of generally positioning the machines, accurately positioning the cutter head 15, and performing milling operations are repeatedly performed. Such processes may be very time consuming, and errors may result in inefficient operation and/or excessive wear of the tools and the components associated with positioning and rotating the tools.

Figure 9:
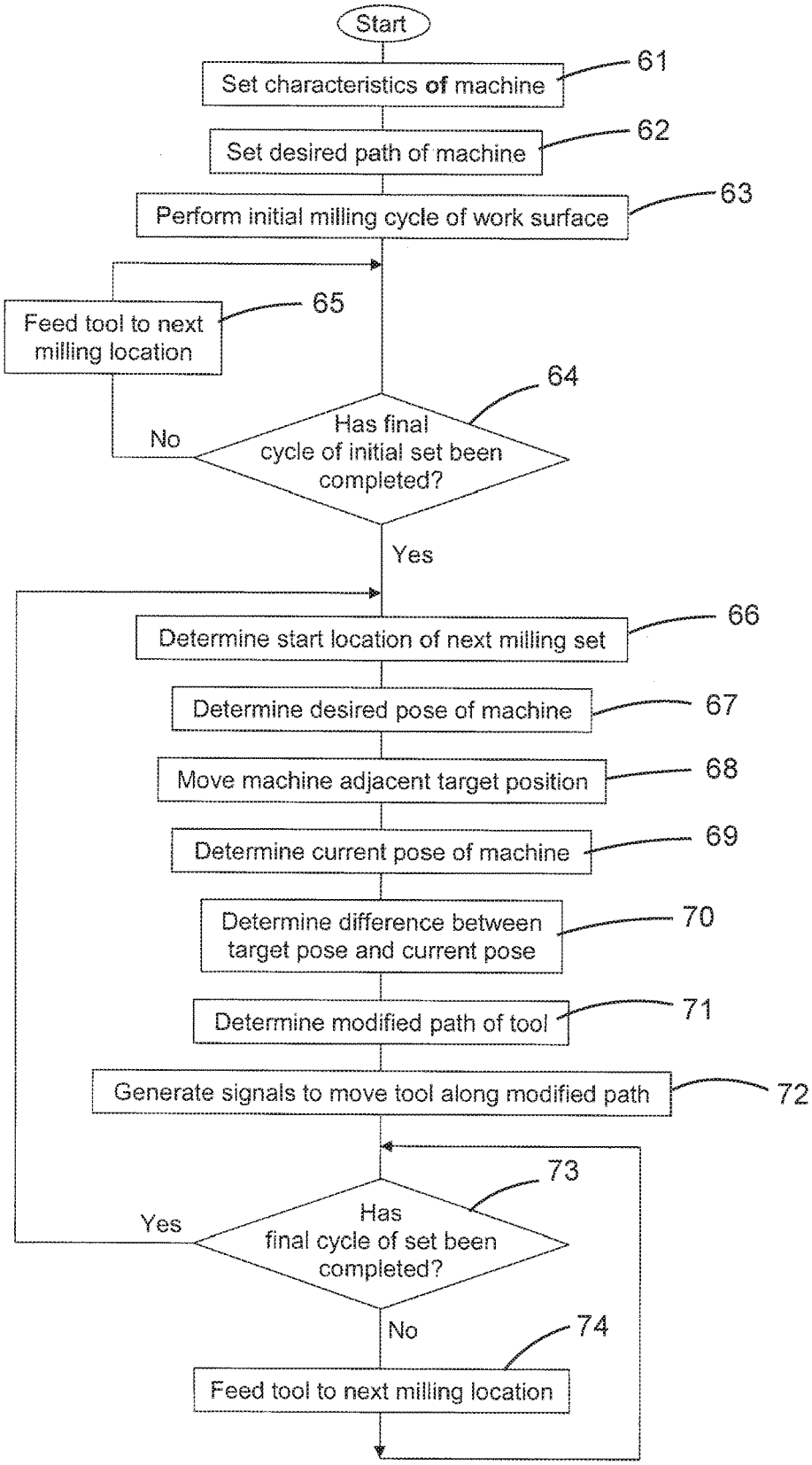
FIG. 9 is a flowchart of a process of the machine operating with milling depth compensation system.

Referring to FIG. 9, a process for milling rock using the milling depth compensation system 47 is depicted. Initially, characteristics of the machine 10 may be set or stored within the controller 41 at stage 61. The characteristics may include, for example, data maps of the machine performance, dimensions of the machine 10, together with adjustments to be made by the milling depth compensation system 47 to compensate for differences between the actual pose of the machine and the target pose. At stage 62, a desired machine path of the machine 10 may be set or stored within the controller 41. In doing so, the path may be divided into a plurality of increments and the increments divided into a plurality of sub-increments. The sub-increments may be used to define a plurality of target points.

At stage 63, the machine 10 may be positioned at the first target point with the boom 21 in its retracted position and an initial milling cycle at the work surface 101 performed. At decision stage 64, the controller 41 may determine whether the final milling cycle of the initial milling set has been completed. In one example, the controller 41 may determine whether the boom 21 has reached its fully extended position. If the final milling cycle of the initial milling set has not completed, the boom may be extended by a distance equal to the milling depth and an additional milling cycle performed at stage 65.

If the boom 21 has completed the final milling cycle of the initial milling set, the controller 41 may determine at stage 66 the starting location or target position of the next milling set. At stage 67, the controller 41 may determine the desired or target pose of the machine 10. To do so, the controller 41 may determine the position of the work surface 101 based upon the path of the cutter head 15 during the last milling cycle, the dimensions of the machine 10, and the position of the machine based upon data from the position sensor 46. In an alternative embodiment, the position of the work surface 101 may be determined based upon data from a perception system. The position of the work surface 101 after each milling set may be used as the initial position of the work surface for the next milling set. Based upon the position of the work surface 101 and the target position for the machine 10, the controller 41 may determine the target pose.

At stage 68, instructions may be provided, such as from an operator operating a remote control 42, to position the machine 10 at the target pose. In doing so, the operator may attempt to position the machine within specified tolerances for the machine operation. The controller 41 may determine at stage 69 the current or actual pose of the machine 10 through the use of the position sensing system 45. At stage 70, the controller 41 may determine any differences between the target pose and the actual pose of the machine 10.

At stage 71, the milling depth compensation system 47 may determine a modified or dynamic milling path along which the cutter head 15 should travel based upon the differences between the target pose and the actual pose of the machine 10. Controller 41 may generate command signals at stage 72 to move the cutter head 15 along the modified or dynamic milling path defined by the milling depth compensation system 47 by actuating any or all of the cylinders 30-32 and gear system 33. At decision stage 73, the controller 41 may determine whether the final milling cycle of the current milling set has been completed. For example, the controller 41 may determine whether the boom 21 has reached its fully extended position. If the final milling cycle of the current milling set has not completed, controller 41 may generate instructions to extend the boom 21 by a distance equal to the milling depth and an additional milling cycle performed at stage 74.

If the final milling cycle of the current milling set has been completed, the process may be repeated at stages 66-74 as desired.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. For example, while the foregoing description has been provided with respect to machines used to cut or mill rock, the foregoing description is applicable to cutting or milling other material and to machines used to cut or mill other material, such as minerals and metals. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A system for milling rock along a work surface, comprising:

a rock milling tool mounted on a machine for removing material along the work surface, the rock milling tool being rotatable about an axis and movable relative to the machine along a first path, a second path, and a third path, the first path being orthogonal to the second path and the third path;

a position sensor associated with the machine for generating position signals indicative of a pose of the machine; and a controller configured to:

store a desired machine path of the machine;

determine a target position of the machine based upon the desired machine path;

determine an initial position of the work surface;

determine a target pose of the machine based on the target position of the machine and the initial position of the work surface;

determine an actual pose of the machine based upon position signals from the position sensor;

determine differences between the actual pose of the machine and the target pose of the machine;

determine a dynamic milling path of the rock milling tool based upon the differences between the actual pose and the desired pose, the dynamic milling path including movement of the rock milling tool along the first path, the second path, and the third path; and generate command signals to move the rock milling tool along the dynamic milling path.

2. The system of claim 1, wherein the controller is further configured to determine a plurality of dynamic milling paths, each of the plurality of dynamic milling paths being based upon the differences between the actual pose of the machine and the target pose of the machine, the plurality of dynamic milling paths defining a milling cycle.

3. The system of claim 2, wherein the controller is further configured to determine a plurality of milling cycles, each of the plurality of milling cycles being differentiated by an in-feed movement of the rock milling tool along the third path.

4. The system of claim 3, wherein the third path is linear and the in-feed movement of the rock milling tool along the third path between each of the plurality of milling cycles is an equal amount.

5. The system of claim 2, wherein the milling cycle comprises a plurality of adjacent arcs.

6. The system of claim 5, wherein the milling cycle comprises a spherical segment.

7. The system of claim 1, wherein the first path is an arc, and the third path is linear.

8. The system of claim 7, wherein the second path is a second arc.

9. The system of claim 1, wherein the rock milling tool comprises a rotatable cutter head with a plurality of tool carriers disposed thereon.

10. The system of claim 9, wherein the plurality of tool carriers are rotatably mounted on the rotatable cutter head.

11. The system of claim 9, wherein the rotatable cutter head is disposed on a support assembly, the support assembly being configured for rotation about a support axis.

12. The system of claim 1, wherein the dynamic milling path comprises an arc.

13. The system of claim 1, wherein the dynamic milling path is linear.

14. The system of claim 1, wherein the position sensor comprises at least one prism.

15. The system of claim 14, wherein the position sensor further comprises an inclination sensor.

16. A method of milling rock along a work surface, comprising:

providing a rock milling tool mounted on a machine for removing material along the work surface, the rock milling tool being rotatable about an axis and movable relative to the machine along a first path, a second path, and a third path, the first path being orthogonal to the second path and the third path;

storing a desired machine path of the machine;

determining a target position of the machine based upon the desired machine path;

determining an initial position of the work surface;

determining a target pose of the machine based on the target position of the machine and the initial position of the work surface;

determining an actual pose of the machine based upon position signals from a position sensor associated with the machine;

determining differences between the actual pose of the machine and the target pose of the machine;

determining a dynamic milling path of the rock milling tool based upon the differences between the actual pose and the desired pose, the dynamic milling path including movement of the rock milling tool along the first path, the second path, and the third path; and generating command signals to move the rock milling tool along the dynamic milling path.

17. The method of claim 16, further comprising determining a plurality of dynamic milling paths, each of the plurality of dynamic milling paths being based upon the differences between the actual pose of the machine and the target pose of the machine, the plurality of dynamic milling paths defining a milling cycle.

18. The method of claim 16, wherein the dynamic milling path comprises an arc.

19. The method of claim 18, wherein the first path is an arc, and the third path is linear.

20. A machine comprising:

a ground engaging drive mechanism for propelling the machine;

a rock milling tool mounted on the machine for removing material along a work surface, the rock milling tool being rotatable about an axis and movable relative to the machine along a first path, a second path, and a third path, the first path being orthogonal to the second path and the third path;

a position sensor associated with the machine for generating position signals indicative of a pose of the machine; and a controller configured to:

store a desired machine path of the machine;

determine a target position of the machine based upon the desired machine path;

determine an initial position of the work surface;

determine a target pose of the machine based on the target position of the machine and the initial position of the work surface;

determine an actual pose of the machine based upon position signals from the position sensor;

determine differences between the actual pose of the machine and the target pose of the machine;

determine a dynamic milling path of the rock milling tool based upon the differences between the actual pose and the desired pose, the dynamic milling path including movement of the rock milling tool along the first path, the second path, and the third path; and generate command signals to move the rock milling tool along the dynamic milling path.

* * * * *